United States Patent [19]

Williamson et al.

[11] Patent Number: 4,867,417

[45] Date of Patent: Sep. 19, 1989

[54] POWER LIFT-ASSIST APPARATUS

[76] Inventors: Robert L. Williamson; Kenneth M. Holden, both of 227 Cottage Grove Ave., Santa Barbara, Calif. 93101

[21] Appl. No.: 172,794

[22] Filed: Mar. 28, 1988

[51] Int. Cl.[4] ..... B66F 3/00

[52] U.S. Cl. ..... 254/124

[58] Field of Search ..... 254/124, 8 R, 8 B, 8 C, 254/9 R, 9 B, 9 C, 10 R, 10 B, 10 C, 122, 124, 93 R; 269/232, 233, 32

[56] References Cited

U.S. PATENT DOCUMENTS 2,862,689 12/1958 Dalrymple et al. ..... 254/122
3,570,835 3/1971 McPherson ..... 269/233

FOREIGN PATENT DOCUMENTS 927600 5/1963 United Kingdom ..... 254/122
1425943 2/1976 United Kingdom ..... 254/10 B

*Primary Examiner*—Robert C. Watson
*Attorney, Agent, or Firm*—Francis X. LoJacono

[57] ABSTRACT

The present invention defines a power lift-assist apparatus that includes a base platform and a load-support platform adapted to move in parallel relation to the base platform. Mounted to the base platform is a pneumatic motor comprising a substantially stationary piston formed with an internal pressure chamber therein and a slidable cylinder which is provided with a pair of cam rollers that are positioned to engage respective cam recesses formed in a carriage-lift framework whereby the load-support framework is activated from a retracted position to a fully extended position.

11 Claims, 2 Drawing Sheets

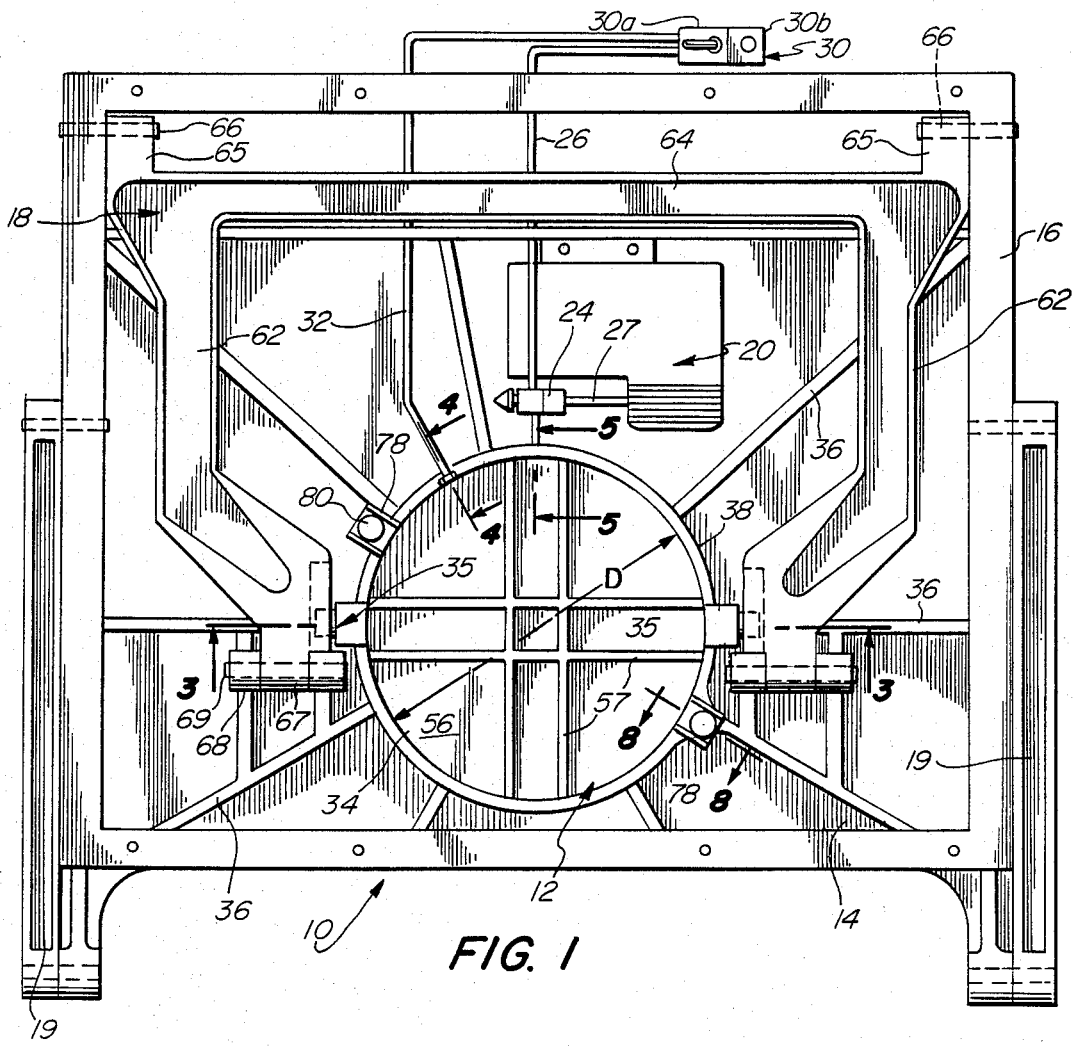
FIG. 1
FIG. 3
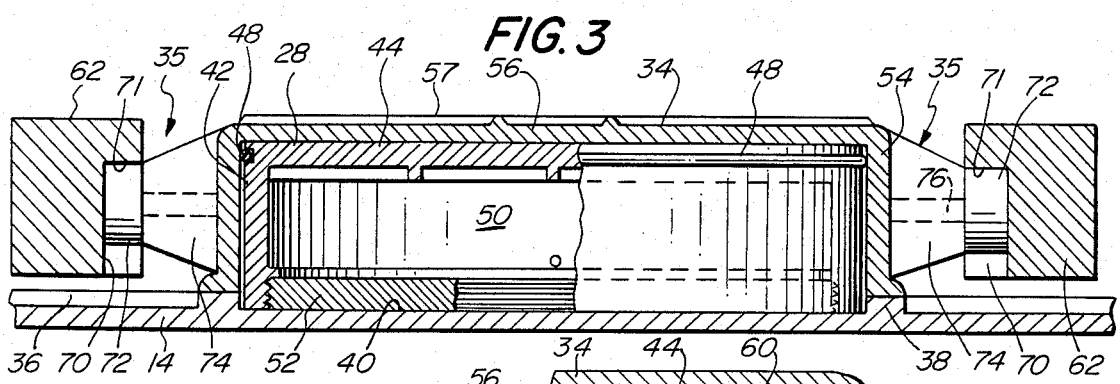
FIG. 8
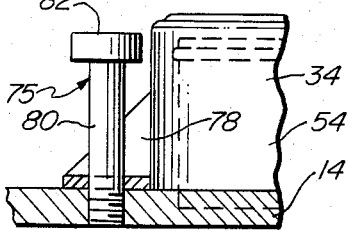
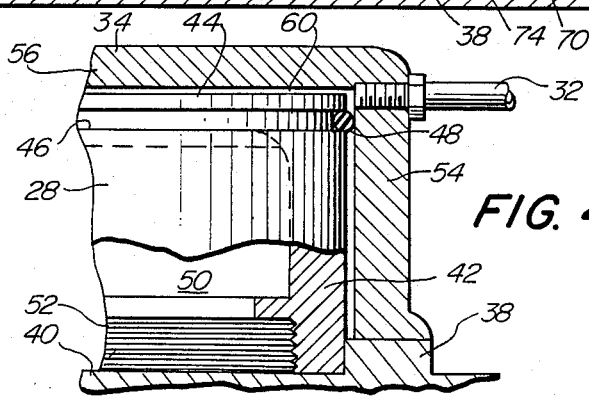
FIG. 4

POWER LIFT-ASSIST APPARATUS

BACKGROUND OF THE INVENTION

1. Field of the Invention

This invention relates generally to a lifting device and more particularly to a lift-assist apparatus having a pneumatic motor which is defined by a substantially stationary piston and a slidable cylinder, wherein the piston further includes a pressure chamber. A carriage-lift framework operably engages the cylinder by means of a cam device.

2. General Description of the Prior Art

It is well recognized in the art that various problems and difficulties have been encountered in lifting heavy articles out of as well as inserting them into very confined areas, especially with respect to trunks and storage wells of passenger cars. These problems exist with all types of passenger vehicles.

Such deep trunk areas have greater capacity for carrying such items as luggage, hardware, typewriters, copier machines, golf clubs, etc., yet in providing such storage space a problem has been created in that it becomes very difficult to remove these same articles stored therein.

Due to many design changes in recent years, motor vehicles tend to be smaller overall and thus difficulties in access to deep-well storage spaces have become very prevalent. To the applicants' knowledge, an apparatus as herein described and claimed has not been available for use in conjunction with passenger vehicles. It should be noted, however, that the present invention is not limited to passenger vehicles but may also be employed in various other fields where there are similar access problems.

Several lift mechanisms have been provided for vehicles but, generally, such devices have been limited to use in truck and/or other larger vehicles. These known devices also have features that restrict their use, and they are complicated and expensive, but first and foremost they are not suitable or compatible for use with present-day passenger vehicles.

As examples of prior-art devices, one may refer to the following United States patents:

U.S. Pat. No. 1,546,698 to L. Zoll et al defines a folding or extension scaffold, and U.S. Pat. No. 2,626,179 to F. C. Gonzalez discloses a convertible truck and trunk compartment for automobiles, which provided a trunk compartment having foldable sides and a foldable bottom to form a truck body, and an extensible frame for the bottom for retracting into a position in a body of the vehicle when the door of the trunk compartment is closed.

Another type of load-carrying vehicle is disclosed in U.S. Pat. No. 3,090,514 issued to W. C. Black, Sr., et al. This invention relates to trucks designed to load and unload cargo into or out of planes, and is provided with a retractable bridge mounted on the truck chassis.

U.S. Pat. No. 3,198,571 to B. F. Mojeski discloses a dualpurpose vehicle wherein the vehicle body can be easily converted from a conventional tonneau-type vehicle to a station wagon body or vice versa.

U.S. Pat. No. 3,687,321 to S. E. Goodnart et al discloses a load-carrying vehicle adapted to load and unload cargo and other material into and out of aircraft.

One may further refer to the following U.S. Pat. Nos.: 2,245,417; 4,456,421; 2,890,908; 4,473,855; 3,228,659; 4,616,972; 4,447,042.

SUMMARY AND OBJECTS OF THE INVENTION

In accordance with the present invention, a self-contained lift-assist apparatus is provided which is designed to lift and position heavy and cumbersome objects with respect to passenger-vehicle storage compartments as well as in other applications in industry, commerce, transportation, etc.

The lift-assist apparatus comprises a pneumatic motor defined by a substantially immovable piston formed with an internal pressure chamber which supplies air pressure to a slidable cylinder in an up-and-down movement, wherein the cylinder is provided with oppositely disposed cam rollers for engagement with a cam member formed in the end portion of each carriage arm, thus defining a lift carriage.

The lift carriage is pivotally mounted to a base-plate framework at one end thereof and to a load-support framework at the opposite end thereof, the base plate framework and the load support framework being pivotally interconnected by a pair of arm members positioned in parallel relation to the carriage arm members. The pneumatic motor is powered by compressed air supplied by an air-supply source to the pressure cell or chamber formed as part of the piston. Thus, a compressor keeps the pressure cell under a constant set pressure controlled by a pressure-regulator switch. The stored pressurized air in the piston air cell or chamber is transferred between the piston and the cylinder which causes the cylinder to move upward over the piston. The upward movement of the cylinder is stopped by a pair of adjustable limit pins. The transfer of air from the piston chamber to the cylinder is accomplished by a pair of hose lines with two air-control flow valves disposed within the hose lines thereof. One valve controls the direction of the air flow and the second valve allows the air to cause the cylinder to go up or down or stop in any selected position.

Thus, it is an important object of the present invention to provide a lift-assist apparatus that includes a pneumatic motor having a substantially fixed piston and a movable cylinder.

Another object of the invention is to provide a lift-assist apparatus wherein the cylinder movement has a very short stroke in comparision to the commonly used pneumatic motors indicated in the prior art.

Still another object of the present invention is to provide a lift-assist apparatus wherein the slidable cylinder is arranged to move a load-support framework from a retracted position to a fully extended position with a very short travel movement of the cylinder, wherein the ratio between the cylinder's diameter to the height of the cylinder's annular wall is approximately 4 to 1.

It is another object of the present invention to provide a lift-assist apparatus that includes a fixed frame structure and a movable frame structure wherein the movable frame structure is adapted to support a platform on which articles can be moved into position for the storage mode or lifted out from the vehicle trunk for the lift mode. In the storage mode, the platform is positioned in the lower portion the trunk well. When the movable structure is activated to a lift mode the platform can be selectively positioned above the well so as to clear the bottom well of the trunk opening.

It is a further object of the present invention to provide an apparatus of this character that allows those individuals who have trouble with their backs or have other handicaps to be able to use the trunks of their vehicles with relative ease.

It is still a further object of the invention to provide an apparatus of this character that is easy to operate and has relatively few operating parts.

A still further object of the invention is to provide a lift-assist device that is easy to service and maintain, is relatively inexpensive to manufacture, and has a simple yet sturdy construction.

A various features of novelty which characterize the invention are pointed out with particularity in the claims annexed to and forming a part of this disclosure. For a better understanding of the invention, its operating advantages of its use, reference should be had to the accompanying drawings and descriptive matter in which there are illustrated and described the preferred embodiments of the invention.

BRIEF DESCRIPTION OF THE DRAWINGS

Referring more particularly to the accompanying drawings, which are for illustrative purposes only and wherein like reference characters represent like elements thereof:

FIG. 1 is a top-plan view of the present invention including a diagram of the pneumatic air-supply unit, the load support framework being shown in a retracted position;

FIG. 3 is an enlarged cross-sectional view taken along line 3—3 of FIG. 1 showing the arrangement of the stationary piston and the movable cylinder together with the position of the oppositely disposed cam means;

FIG. 4 is an enlarged cross-sectional view of the piston and cylinder taken along line 4—4 of FIG. 4 showing the pressure inlet lines positioned above the "O" ring of the piston;

FIG. 5 is an enlarged view of a portion of the piston and cylinder taken along line 5—5 of FIG. 1 wherein the air pressure transfer hose line is attached to the piston so as to communicate with the pressure chamber provided within the piston;

DESCRIPTION OF THE PREFERRED EMBODIMENT

Figure 2:
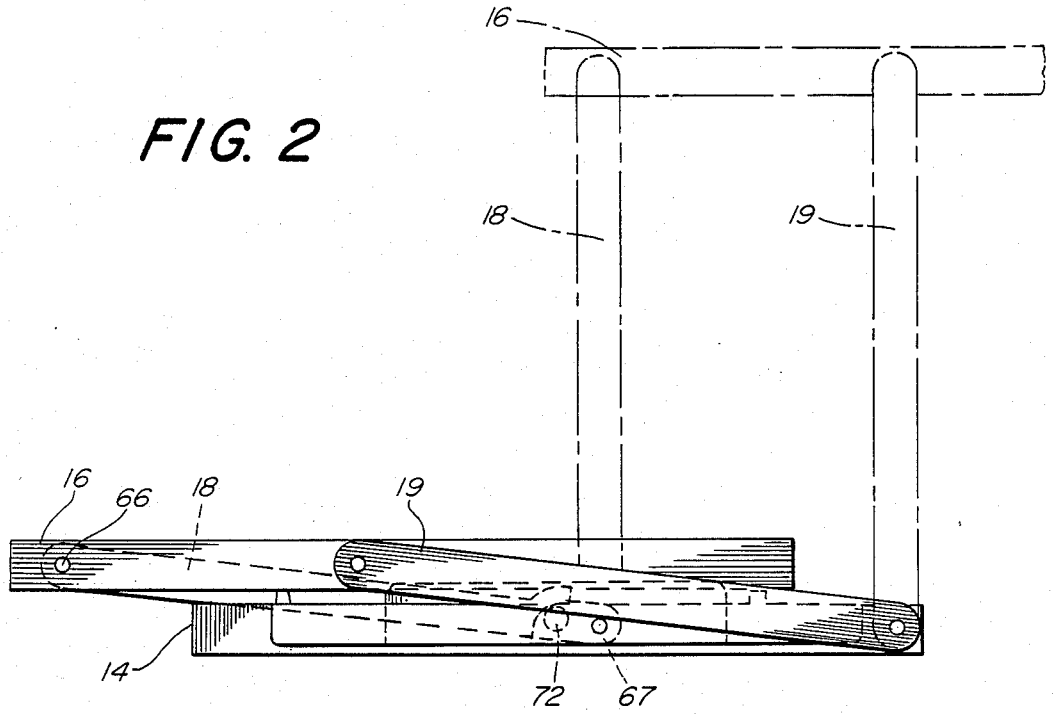
FIG. 2 is a side-elevational view thereof with the load-support framework shown in phantom lines in a fully extended position.

Referring now in more detail to the drawings, there is shown in the top-plan view of FIG. 1 of the present invention a lift-assist apparatus, generally designated at 10, having a pneumatic motor, indicated generally at 12, mounted to a base platform 14 and operably attached to a load-support framework 16 by way of carriage-lift framework, generally indicated by numeral 18, and by strut means 19 defined by a pair of oppositely positioned idler arm members.

Further, in FIG. 1 there is schematically shown an air-pressure supply means 20 defined by a small air compressor 22 which includes an air-pressure-control switch 24. The switch is interposed in hose line 26 which is attached at one end to a cylindrical housing defining a piston 28 and at the opposite end to a control-valve means, generally indicated at 30. A second hose line 32 is connected between valve means 30 and the cylinder 34 of the pneumatic motor 12.

Base platform 14 is formed with a generally rectangular shape, although the configuration may be made to correspond to the particular placement of the apparatus. Base 14 is further defined as having a plurality of rib members 36 integrally formed with a circular rib member 38 which defines a circular recess 40 adapted to receive piston 28 therein, as seen in FIG. 3. Circular rib member 38 also provides a support means for outer cylinder 34 when in a retracted position.

Accordingly, piston 28 is freely supported within recess 40 and is therefore positioned in a substantially stationary arrangement. That is, piston 28 is stationary relative to movable cylinder 34. Hence, during the operation of the lift assist apparatus, piston 28 remains stationary while cylinder 34 is allowed to slide up and down relative thereto. Piston 28 is formed with an annular wall 42 and an integrally formed flat head wall 44. An annular groove 46 is disposed in side annular wall 42 so as to receive and support "O" ring seal 48 therein, the groove being located adjacent the upper end of wall 42, as indicated in FIGS. 3 and 4 of the drawings. To establish the unique concept of the present invention, piston 28 is further formed to provide a pressure tank by means of pressure chamber or cell 50 which is defined by annular wall 42, piston head wall 44, and by a sealed cap or plug 52. The cap is shown as being threaded in the bottom open end of piston 28. Air pressure is allowed to enter and exist through air line 26, as seen in FIG. 5.

Figure 7:
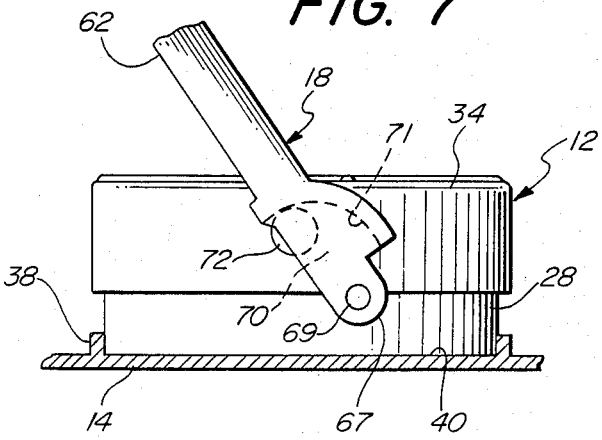
FIG. 7 is a schematic view of the pneumatic motor wherein the cylinder is illustrated in an extended position.

Slidable cylinder 34 is formed with a cylindrical wall 54 and an upper, substantially flat head wall 56 which includes ribs 57 for strength. The inner diameter of cylinder 34 fits over piston 28 so as to be in engagement with "O" ring 48. Pressure-inlet line 32, as seen in FIG. 4, is attached to wall 54 adjacent the upper closed end of the inner cylindrical compartment 60. Thus, pressurized air from pressure compartment 50 is transferred into compartment 60 just above "O" ring 48 whereby cylinder 34 can be accuated in an upward sliding direction, as indicated in FIG. 7.

Accordingly, the upward movement of cylinder 34 will cause carriage 18 to rise from a substantially horizontal position to a relatively vertical position, as seen in FIG. 2. The movement imparted to carriage 18 is provided by a cam means 35 interposed between the carriage and cylinder 34. Carriage-lift framework 34 is formed with oppositely disposed carriage-arm members 62 that are interconnected by a strut member 64 at one end thereof to define a somewhat "U" shaped configuration. The upper end of each carriage arm is provided with an extended finger member 65 which is pivotally attached to load-support framework 16 (FIG. 1) by pin 66. The opposite lower end of each carriage arm is also provided with an extended finger 67 which is journaled between a pair of ear members 68 by pin 69. The lower end of each carriage arm also includes part of cam means 35.

Cam means 35 comprises an arcuate curved recess 70 formed in each oppositely disposed carriage-arm member 62. (See FIGS. 6 and 7.) The recesses 70 establish cam surfaces 71 that engage cam rollers 72 which are rotatably mounted to circular wall 42 of cylinder 34. Cam rollers 72 are attached by means of support-ear members 74 and roller pins 76, as better viewed in FIG. 3.

Compressor 24 is shown in FIG. 1 as being mounted to the base platform. However, it is contemplated that various suitable compressor units can be employed remotely from the overall framework of the apparatus when required. Accordingly, compressor 24 is connected to a suitable power source (not shown) which operates the compressor in conjunction with air-pressure-control switch means 24, wherein the switch means can be set to operate under specific pressure demands required to correspond to the proper operation of the pneumatic motor unit 12. That is, the various sizes of pneumatic motor units will require different pressure ratings.

Figure 8:
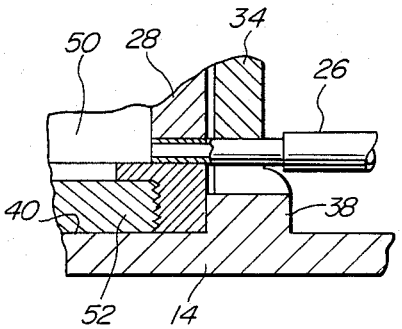
FIG. 8 is an enlarged view of a limit-pin arrangement taken on line 8—8 of FIG. 1.

At this time, it should be noted that the present invention is designed to provide a maximum movement of the load-support framework with a minimum of movement of cylinder 34. As an example, a cylinder having an eight-inch diameter "D" and a two-inch high annular wall 54 need only rise upwardly approximately one inch in order to fully lift load-support member 16 from a retracted position to a fully extended position. Thus, the ratio of sizes between the diameter and the height of the cylinder is approximately four to one. A limit means 75 shown in FIG. 8 limits the upward stroke of cylinder 34. The limit means comprises a pair of brackets 78 attached to cylinder wall 54, the brackets each being adapted to receive a fixed limit pin 80 secured to base 14. As cylinder 34 moves upwardly, each bracket will be limited in movement as it engages the head 82 of limit pin 80.

Operation

Compressor 24 operates to supply a given air pressure by means of air-pressure-control switch 24. As an example, if the proper operation of a pneumatic motor requires a minimum air pressure within pressure chamber 50, pressure-control switch 24 will cause compressor 20 to operate, thus pumping air into pressure chamber 50 by way of line 27, switch means 24 and line 26. Air flow is directed into chamber 50 by closing an air-flow control valve 30a of valve means 30 so as to prevent air from flowing into line 32, while pressurizing chamber 50.

Figure 6:
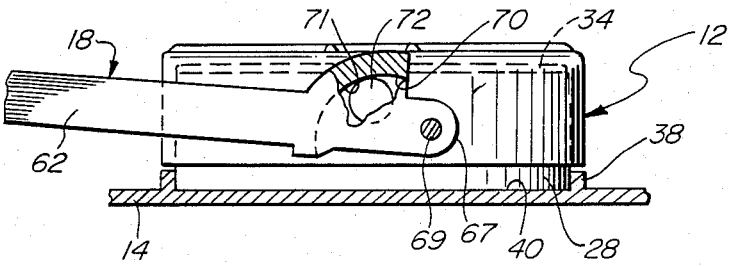
FIG. 6 is a schematic view of the pneumatic motor wherein the cylinder is positioned in a retracted mode of operation and the carriage arm is in a lowered, substantially horizontal position.

When a maximum set pressure is reached in chamber 50, air can then be directed into cylinder compartment 60 by opening valve **30*a* whereby air pressure from chamber 50 is transferred through lines 26 and 32, thus causing cylinder 34 to slide upwardly over piston 28, as seen in FIGS. 6 and 7. As the cylinder rises, cam rollers engage the cam surface formed in each carriage arm 62. Accordingly, carriage 18 pivots about pins 69, thus imparting a lifting action to load-support framework 16 which is further arranged with a side idler arm member to define a parallelogram arrangement between load-support framework 16 and base framework 14, as indicated in FIG. 2, framework 16 remaining level at all times. The load-support framework 16** can thus be positioned at any height from a fully retracted position to a fully extended position.

To retract (lower) load-support framework 16, an air release valve **30*b* is operated, allowing pressure in chamber 50 to be vented to atmosphere under a controlled movement. That is, air flows back through line 32 and to atmosphere by operating valve 30*a* to prevent flow of air from chamber 50 being released when valve 30*b* is operated. Thus, flow valve 30*a* controls the direction of air flow while release valve 30*b* controls the up-and-down movement of cylinder 34**. Although not shown, one or more springs may be attached between the base plate and lifting mechanism to assist the downward movement thereof.

The foregoing is a description of a preferred embodiment of the invention which is given here by way of example only. The invention is not to be taken as limited to any of the specific features as described, but comprehends all such variations thereof as come within the scope of the appended claims.

What we claim is:

1. A power lift-assist apparatus comprising:

a base platform;

a load-support framework movable in parallel relation to said base platform;

a pair of strut means operably connected between said base platform and said load-support framework;

a pneumatic motor having a slidable cylinder and a substantially stationary piston, said cylinder being slidably positioned over said stationary piston so as to move up and down with respect to said piston;

a carriage frame member being pivotally attached at one end thereof to said base platform and at the opposite end thereof to said load-support framework, whereby said load-support framework is movable in parallel relation to said base platform when said cylinder of said pneumatic motor is activated;

an air-pressure chamber formed as an integral part of said piston whereby air pressure stored therein is used to operate said pneumatic motor;

means for supplying air pressure to said air-pressure chamber; and cam means interposed between said pneumatic motor and said carriage frame member so as to raise and lower said carriage.

2. A power lift-assist apparatus as recited in claim 1, wherein strut means comprises a pair of idler arm members interconnected at their ends to said carriage frame member and said base member.

3. A power lift-assist apparatus as recited in claim 1, including means for limiting the slidable movement of said cylinder in an upward direction.

4. A power lift-assist apparatus as recited in claim 3, wherein said cam means comprises:

oppositely disposed arcuate recesses formed in said carriage frame member and having cam surfaces therein; and a pair of cam rollers attached to said slidable cylinder and arranged to be received in said arcuate recesses for engagement with said cam surfaces thereof.

5. A power lift-assist apparatus as recited in claim 4, wherein said piston comprises:

a cylindrical housing defined by an annular side wall, an integrally formed head wall, and an open lower end;

an annular groove formed in said side wall;

a sealing ring mounted in said groove; and a cap member secured within said open end thereof whereby said pressure chamber is defined within said piston.

6. A power lift-assist apparatus as recited in claim 5, wherein said air-pressure-supply means includes:

a compressor adapted to communicate with said air-pressure chamber;

a pressure-sensitive switch means interposed to control air pressure flowing to said pressure chamber from said compressor;

valve means connected between said pressure chamber and said slidable cylinder to control the movement of said cylinder,

7. A power lift-assist apparatus as recited in claim 6, wherein said valve means comprises:

an air-flow-control valve to control air pressure from said tank to said cylinder; and release valve to control the up-and-down movement of said load-support framework.

8. A power lift-assist apparatus as recited in claim 7, wherein the ratio of size between the diameter of said head wall of said cylinder and the height of said annular side wall thereof is four to one.

9. A power lift-assist apparatus comprising:

a pneumatic motor having a substantially stationary piston;

a slidable cylinder formed to be slidably mounted over said stationary piston;

a pressure chamber formed in and defined by said piston;

cam means attached to said slidable cylinder; and a carriage frame member formed with a pair of oppositely disposed carriage-arm members interconnected by a strut member to define a substantially "U" shaped configuration, wherein said carriage arm members are formed to engage with said cam means.

10. An apparatus as recited in claim 9, wherein said cylinder comprises:

a cylinder head wall;

an annular side wall integrally formed therewith;

an inlet/outlet port disposed in said annular side wall whereby air pressure is transferred therefrom;

said piston being formed with a cylindrical housing defined by an annular side wall, a piston head wall and an open end;

an annular groove formed in said side wall;

a sealing ring mounted in said groove;

a cap member secured within said open lower end of said cylindrical housing whereby said pressure chamber is defined within said piston; and a port disposed in said annular side wall to communicate with said pressure chamber and to transfer air pressure to and from said pressure chamber.

11. An apparatus as recited in claim 10, wherein the diameter of said cylinder head wall is four times the height of said annular side wall thereof.

* * * * *